United States Patent [19]

Osborne

[11] 4,280,163

[45] Jul. 21, 1981

[54] ELECTRONIC LOCK

[75] Inventor: William E. Osborne, Whittier, Calif.

[73] Assignee: Homexx International Corp., Anaheim, Calif.

[21] Appl. No.: 17,244

[22] Filed: Mar. 5, 1979

[51] Int. Cl.[3] ..... E05B 49/00

[52] U.S. Cl. ..... 361/172; 70/277; 361/203

[58] Field of Search ..... 361/172, 188, 203; 340/147 MD; 70/277, 278

[56] References Cited

U.S. PATENT DOCUMENTS

| | | | |
|---|---|---|---|
| 3,283,550 | 11/1966 | Bradway | 361/172 X |
| 3,787,714 | 1/1974 | Resnick et al. | 361/172 |

*Primary Examiner*—Harry E. Moose, Jr.
*Attorney, Agent, or Firm*—Paul A. Weilein

[57] ABSTRACT

An electronic lock mechanism in which the odds against picking or unauthorized opening are extremely high, and wherein an electrically operable bolt is connected with the output of an oscillator in the bolt control circuitry that includes a resistance bridge network including regenerative differential electronic switches connected to selectively activate a pair of relays with series connected contacts in accordance with the direction of unbalance of the bridge, and to activate both relays in response to a balanced operative mode of the bridge so that the relay contacts will coact to close a power supply connection to the oscillator. A control key insertable in a mating keyhole is operative to connect the bridge with a voltage source, insert a resistor component into the bridge network of a value to balance the bridge, and also place a resonating capacitor into a tuned circuit of the oscillator and thereby activate the lock bolt to an unlocked position. An additional security feature includes an RC circuit for introducing a predetermined delay in the time required for the bridge to reach a balanced operation mode.

9 Claims, 2 Drawing Figures

ELECTRONIC LOCK

PRIOR ART

In the prior art, there are numerous electronic locking devices, security devices, and alarm systems in which a control key contains one or more circuit activating components to control an electric bolt or signal alarm. The closest art known to applicant are the following U.S. Pat. Nos.:

3,134,254: May 26, 1964
3,347,072: Oct. 17, 1967
3,518,655: June 30, 1970
3,656,001: Apr. 11, 1972
3,673,467: June 27, 1972
3,921,040: Nov. 18, 1975
4,013,930: Mar. 22, 1977

BACKGROUND OF THE INVENTION

The present invention relates generally to electrically controlled key actuated locks.

In an effort to provide for greater security in door locks, security devices and alarm systems, there has been developed heretofore a multiplicity of control circuits for controlling the actuation of an electric bolt or signal alarm by means of a key member which is utilized to insert one or more circuit components into the control circuitry. These prior art arrangements have ranged from simple to complex, and relatively vary with respect to their security effectiveness.

For example, it is broadly known from U.S. Pat. Nos. 3,921,040 and 3,518,655 to utilize in an electronic lock a balanced bridge concept and an insertable key containing a resistor which forms one leg of the bridge. U.S. Pat. No. 3,673,467 discloses an arrangement which utilizes two bridge circuits with a key arranged to insert resistance components in each bridge circuit.

U.S. Pat. Nos. 3,347,072 and 3,134,254 disclose the broad general concept of utilizing a control key with a circuit element therein, an oscillator, an output circuit containing an amplifier and a solenoid coil to retract a bolt.

It has also been known generally from U.S. Pat. No. 4,013,930 to utilize in an electric door lock, two timing circuits to actuate the door-opening mechanism. The second timer fires a Schmitt type trigger.

Another approach is disclosed in U.S. Pat. No. 3,656,001 which utilizes a single bridge arrangement with two of the bridge components being contained in the key. The arrangement includes a relay having contacts which can be utilized for the control of a solenoid operated door lock, this relay being controlled by obtaining zero output simultaneously from two or more balanced circuits and a controlling key device.

While the present invention utilizes a key for inserting components into the bridge network and an oscillator network for the control of a control relay for the electric lock device, the elements are in general associated in a differently combined arrangement which utilizes the output of the bridge network to operate regenerative differential electronic switches that are connected to selectively activate a pair of relays with series connected contacts in accordance with the direction of unbalance of the bridge, and to activate both relays in response to a balanced operative mode of the bridge so that the relay contacts will coact to close a voltage connection to the oscillator network. The arrangement is entirely different from that disclosed or taught by any of the noted prior art patents.

SUMMARY OF THE INVENTION

The present invention is more specifically concerned with a unique control means and system for electrically operable locks, and in which the odds against picking or unauthorized opening are extremely high.

It is one object of the present invention to provide an improved electronic lock having a simplified yet extremely reliable control circuitry which is controlled by a key having circuit completing components therein.

A further object is to provide unique means for the control of an oscillator network in the control circuitry of an electrically operable lock mechanism, in which circuit components are carried by the key means and which, upon insertion of the key, operate to both activate a bridge controlled switching means so as to connect the oscillator network with a voltage source, and concurrently insert a resonating component in a tuned circuit of the oscillator.

Another object is to provide control means according to the previous object in which the bridge controlled switching means comprises a pair of regenerative differentially connected electronic switch means connected with the bridge output, and being operative to selectively activate a pair of relays having series connected contacts, which must both be closed to effect connection of the oscillator network with a voltage supply source, according to the direction of unbalance of the bridge, and to activate both of the relays in response to a balanced operative mode of the bridge so as to close the series connected contacts of the relays and complete connection of the oscillator network to the voltage source.

Still another object is to provide in such control means, a time delay circuit under control of the key means, for delaying the time required for the bridge to reach a balanced operative mode.

Further objects and advantages of the invention will be brought out in the following part of the specification, wherein detailed description is for the purpose of fully disclosing several embodiments of the invention without placing limitations thereon.

BRIEF DESCRIPTION OF THE DRAWINGS

Referring to the accompanying drawings, which are for illustrative purposes only.

DESCRIPTION OF THE SEVERAL EMBODIMENTS

Figures 1, 2:
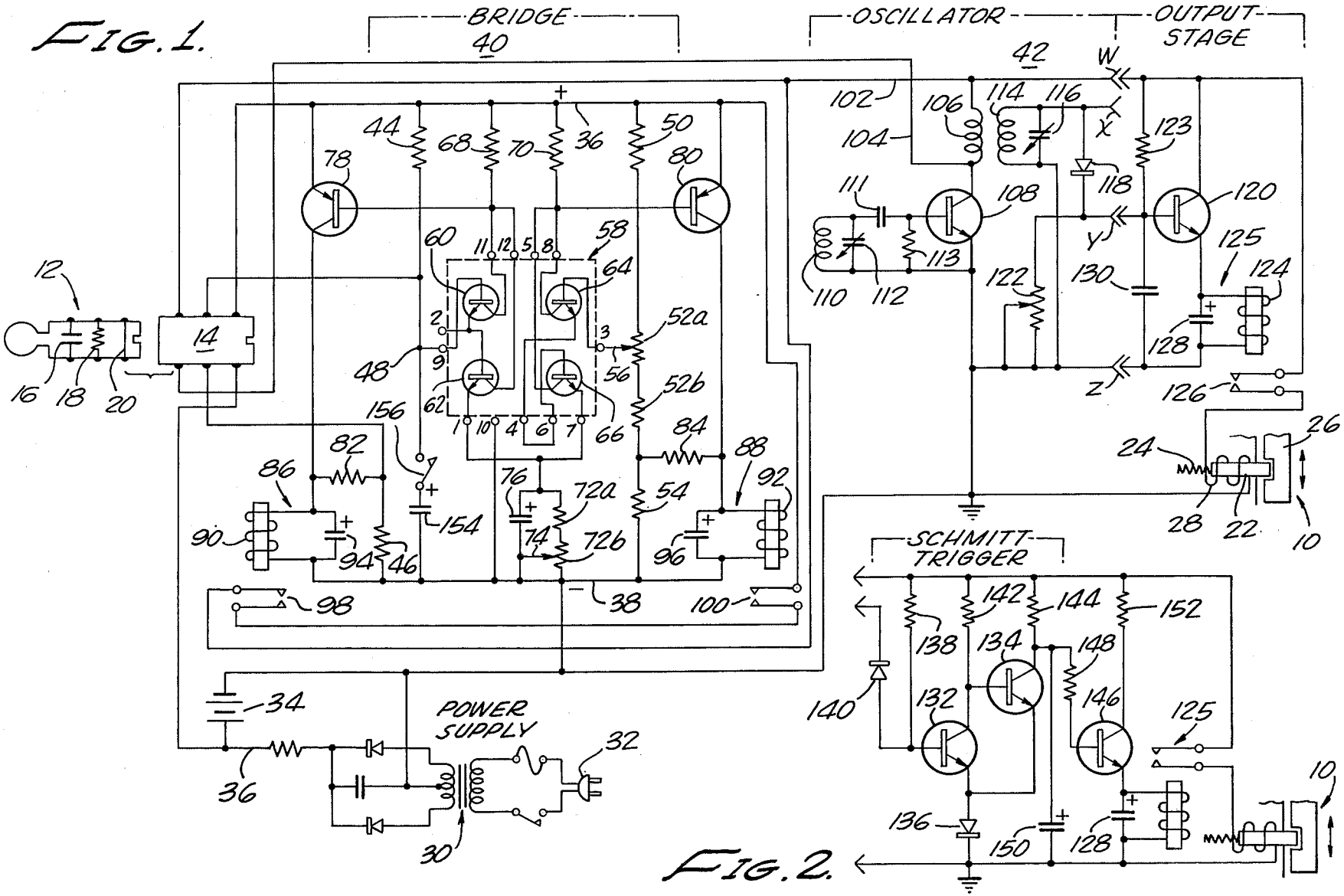
FIG. 1 is a detailed schematic circuit diagram of an electronic lock according to the present invention, the output of the oscillator being connected with an output stage.
FIG. 2 is a schematic circuit diagram of a Schmitt trigger and connected output buffer stage, which may be alternately connected to the oscillator, as shown in FIG. 1, in place of the output stage.

Referring more specifically to the drawings, for illustrative purposes, the invention is shown in one arrangement in FIG. 1 as comprising generally an electrically operated bolt 10 which is operatively connected with control circuitry, which will subsequently be described in detail, the control circuitry being arranged for actuation by means of a control key 12 having one or more circuit components therein and being adapted for insertion into a mating keyhole or receptacle 14. The control key and receptacle may embody any desired construction. Preferably, the key is of a dielectric material and in the present instance is provided with a capacitor 16, a resistor 18 and a conducting bar 20, which are respectively connected between appropriate contacts which are adapted to connect with mating contacts in the receptacle 14, when the key is inserted therein. The electrically operated bolt 10 may likewise vary as to the details of construction. In the illustrated embodiment, the bolt is shown as comprising a solenoid plunger 22 which is normally motivated by a spring 24 into a locked position with respect to a movable door member 26. A solenoid coil 28 is operative upon energization to motivate the plunger to an unlocked position.

The electronic lock is connected with an appropriate power supply, as generally indicated at 30, and which is adapted for connection by means of a connection plug 32 for connection with a domestic electric system, for example, 115 volts. The power supply is illustrated as being of the full-wave rectifying type with an appropriate output DC voltage as required for the control circuitry of the electronic lock. In the illustrated embodiment, the output voltage is 12 volts, and the power supply output is preferably connected with a rechargeable battery 34, the terminals of which are connectible with a positive bus conductor 36 and a negative bus conductor 38 which is grounded.

An important feature of the present invention is that the control key 12 is utilized to necessarily place a bridge network 40 into a balanced operative mode and concurrently connect and initiate the oscillation of an oscillator 42 in order to operate the bolt 10 to an unlocked position. The bridge network 40 has input connections with the positive and negative conductors 36 and 38. One side of the bridge network comprises series connected resistors 44, 18 and 46, with the juncture between resistor 44 and resistor 18 being connected with a bridge terminal 48. In a similar manner, the other side of the bridge network comprises series connected resistors 50, **52*a*, 52*b* and 54, the resistor 52*a* being variable and having a wiper contact which forms a bridge terminal 56**.

The terminals 48 and 56 of the bridge network provide input connections for a regenerative differential electronic switching means, as generally indicated by the numeral 58. For this purpose, a single integrated chip of the Sylvania type ECG904 may be utilized. This chip contains four transistors 60, 62, 64 and 66 which are wired to provide a pair of Darlington connected transistors for each of the differentially connected electronic switches. As shown, the collector of transistor 60 is connected to chip terminal 11 and thence through a resistor 68 to the positive voltage bus. The base of transistor 60 is connected with chip terminal 9 which is in turn connected to the bridge terminal 48. The emitter of this transistor is connected to the base of transistor 62 which has its collector connected to terminal 12 of the chip which is jumper connected with terminal 11. The emitter of transistor 62 is connected with terminal 1 of the chip. Transistor 64, in a similar manner, has its base connected with chip terminal 3 which in turn is connected to the bridge terminal 56. The collector of this transistor is connected to terminal 8 of the chip and thence through a resistor 70 with the positive voltage conductor 36. The emitter of transistor 64 is connected via chip terminals 4 and 6 with the base of transistor 66 which has its collector connected with chip terminal 5 which is jumper connected with chip terminal 8. The emitter of transistor 66 is connected with chip terminal 7, and terminals 1 and 7 are interconnected and have a connection to the negative voltage conductor 38 through series connected resistors **72*a* and 72*b*, the latter having a wiper adjusting contact which permits adjustment of the tolerance of the switching means 58 from approximately 0 to 5%. The effective resistance of resistors 72*a* and 72*b* is bridged by a capacitor 75**.

The outputs of the transistors 60, 62 and 64, 66 respectively feed the bases of semi-power class transistors 78 and 80. The collectors of the transistors 78 and 80 are respectively connected to moderately-low value resistors 82 and 84 which supply a fractional amount of regenerative voltage back to the inputs of the switching means 58 which is made possible by the previously mentioned resistors 46 and 54. The emitters of the transistors 78 and 80 are respectively connected with the positive voltage conductor 36, and the output collectors of these transistors are respectively connected to operate relays 86 and 88 which have their respective actuating windings 90 and 92 bridged respectively by capacitors 94 and 96 to suppress transients. These relays have normally open sets of contacts 98 and 100 which are connected in series and are operative when both sets of contacts are closed to connect the positive voltage conductor 36 with a conductor 102 which forms one side of the input to the oscillator 42. With the arrangement as described, it will be apparent that a balanced operative mode of the bridge must obtain in order to close the contacts 98 and 100 of the relays in order to provide a connection from one side of a voltage supply to the oscillator. If the bridge is unbalanced in either direction, only one set of the relay contacts will close, and this connection to the oscillator will not be completed.

Further, it will be seen that when the key 12 is inserted into the socket 14, the conducting bar 20 will operate as a switch to connect the positive terminal of the battery 34 with the positive bus conductor 36 and cause it to be energized. At the same time, the resistor 18 is operatively connected into the bridge network, and the capacitor 16 is connected between conductor 102 and a conductor 104 in a manner to place the capacitor 16 in bridging relation to an output inductance coil 106 in a tuned collector circuit of an oscillator transistor 108, and thereby initiate its oscillation. The value of the capacitor 16 may range from about 25 to 100 picofarads, depending upon the oscillator frequency desired, which frequency may be anywhere in the 2 Mhz–100 Mhz range, but in practice would probably be 5–10 Mhz. Preferably, the oscillator is of the tuned-base, tuned-collector type. The tuned-base network comprises an input inductance coil 110 which is pre-tunable by a variable capacitor 112. One end of the inductance coil 110 is connected through a capacitor 111 to the base of the oscillator transistor, and a resistor 113 is connected between its base and emitter. A secondary output inductance coil 114 is pre-tunable by a variable capacitor 116. The output of the oscillator is rectified by a diode 118 having a connection with an output connection terminal X from which it is fed to the base of a power output transistor 120 as a forward bias. A variable resistor 122 permits pre-setting of the firing point of this transistor prior to installation. The base of transistor 120 is connected through a resistor 123 to the positive voltage conductor, and has its output circuit connected with the actuating winding 124 of a relay 125 which is operable upon energization to close a pair of normally open contacts 126 and connect the solenoid coil 28 of the electrically operated bolt 10 to the 12 volt power supply, and thus motivate the bolt to an unlocked position. A capacitor 128 is connected across the winding 124 to suppress transients, and a capacitor 130 connected between the base of transistor 120 and the negative grounded voltage conductor also acts as a stabilizer and aids in suppressing transients. The connection of the output stage containing the transistor 120 is further completed by means of connection terminals W and Z.

As an alternative to the use of the output stage as shown in FIG. 1 to operate the electrically operable bolt, a Schmitt trigger and connected output buffer stage, as shown in FIG. 2, may be connected with the connection terminals W, X and Z.

The Schmitt trigger is conventional and is disclosed as comprising two transistors 132 and 134 which have their emitters connected through a common diode 136 to the negative voltage conductor. The base of transistor 132 is connected through resistor 138 to the positive voltage conductor and to the output of the oscillator at connection terminal X through a reversed diode 140. The transistor 134 has its base connected to the positive voltage conductor through a resistor 142 and to the collector of transistor 132. The collector of transistor 134 is connected with the positive voltage conductor through a resistor 144 and to the base of an output buffer stage transistor 146 through a protective resistor 148. The collector of transistor 134 is also connected to the negative voltage conductor through a stabilizing capacitor 150 for suppressing transients. The transistor 146 has its collector connected with the positive voltage conductor through a resistor 152, while the emitter is operatively connected with the relay 125 for controlling the electrically operated bolt 10 in the same manner as previously described.

As thus arranged, transistor 132 is negatively biased and draws only medium current. When triggered, a sharp positive bias of high voltage positively triggers transistor 134 which then triggers the buffer stage transistor 146.

A further feature of the invention provides a time delay circuit for increasing the effective security of the electronic lock by introducing a predetermined delay in the time required for the bridge to reach a balanced position. Since the bridge network utilizes a bridge balancing resistor in the key, it would be possible for a sophisticated burglar to use a variable resistor to find the correct resistance value for effecting a balanced bridge mode. However, this can be circumvented by the time delay arrangement shown in FIG. 1 as comprising a capacitor 154 which is connectible by means of a suitable switch 156 between bridge output terminal 48 and the negative voltage conductor 38. As thus connected, the capacitor, when charged, provides an RC timing circuit in which the resistors 44 and 50 of the bridge are in parallel connected relation with the capacitor through the power supply or the battery 34 which has a low impedance. By choosing the proper components, a time delay period may be obtained in the order of 1–5 seconds. For example, if the resistors are each of 50,000 ohms, and the capacitor of 100 mfd., a time delay period of 2½ seconds would be introduced in the time required to balance the bridge and open the door bolt.

The values of components as used in the circuitry of the herein disclosed invention are listed as follows:

| | |
|---|---|
| TRANSISTORS | |
| 60, 62, 64, 66 | 2N2222 |
| 78, 80 | 2N3073 |
| 108 | 2N3137 |
| 120 | 2N1714 |
| 132, 134, 146 | 2N2484 |
| DIODES | |
| 118 | 1N795 |
| 136, 140 | 1N914 |
| RESISTORS | |
| 18, 44, 50, 52b | 47K |
| 46, 54 | 100 |
| 52a, 72b | 10K |
| 68, 70 | 18K |
| 72a | 120 |
| 82, 84 | 4.7K |
| 113 | 390K |
| 122 | 500K |
| 138 | 10M |
| 142 | 100K |
| 144 | 120K |
| 148 | 75K |
| 152 | 200 |
| CAPACITORS | |
| 16 | 25pf |
| 76 | .5mf |
| 94, 96, 128 | 10mf |
| 111 | 100pf |
| 112, 116 | 7–55pf |
| 130 | .001 mf |
| 150 | .003mf |
| 154 | 100mf |
| INDUCTANCE | |
| 106, 110, 114 | 10μH |

From the foregoing description and drawing, it will be clearly evident that the delineated objects and features of the invention will be accomplished.

Various modifications may suggest themselves to those skilled in the art without departing from the spirit of the herein disclosed invention and, hence, it is not wished to be restricted to the specific component values designated or the form shown or uses mentioned, except to the extent indicated in the appended claims.

What is claimed is:

1. Electronic lock mechanism, comprising:

electrically operable bolt means having an energizing circuit;

a resistance bridge network having an input circuit and output circuit;

key means for controlling the activation of said bolt means, said key means in use being operative to connect the input circuit of said bridge with a voltage source and insert a resistor component into said bridge network of a value to balance the bridge; and control means including switching means connected with the output circuit of said bridge network and being operative in a balanced bridge mode to connect the energizing circuit of said bolt means with said voltage source, said switching means comprising:

a pair of relays having their contacts connected in series and requiring simultaneous closure for the energization of said bolt; and a pair of regenerative differentially connected electronic switch means having input connections respectively with the output junctures of said bridge network, and outputs respectively connected with said relays, and being operative to selectively activate the relays according to the direction of unbalance of said bridge, and to activate both of the relays in response to a balanced operative mode of said bridge.

2. A lock mechanism according to claim 1 in which:
each of said elecronic switch means comprises a pair of Darlington connected transistors.

3. Electronic lock mechanism, comprising:
electrically operable bolt means having an energizing circuit;
a resistance bridge network having an input circuit and output circuit;
key means for controlling the activation of said bolt means, said key means in use being operative to connect the input circuit of said bridge with a voltage source, and insert a resistor component into said bridge network of a value to balance the bridge;
control means including switching means connected with the output circuit of said bridge network and being operative in a balanced bridge mode to connect the energizing circuit of said bolt means with said voltage source; and
means controlled by said key means for delaying the time required for the bridge to reach a balanced operative mode.

4. A lock according to claim 3, in which:
the time delay means includes a capacitor connected between the bridge terminal juncture of the resistor component inserted by said key and the negative side of said voltage source.

5. Electronic lock mechanism, comprising:
electrically operable bolt means having an energizing circuit;
a resistance bridge network having an input circuit and output circuit;
key means for controlling the activation of said bolt means, said key means in use being operative to connect the input circuit of said bridge with a voltage source, and insert a resistor component into said bridge network of a value to balance the bridge;
control means including switching means connected with the output circuit of said bridge network and being operative in a balanced bridge mode to connect the energizing circuit of said bolt means with said voltage source, and an oscillator means; and
said key means being operative to resonate said oscillator means.

6. A lock mechanism according to claim 5, in which:
said key means inserts a capacitor into a resonating network of said oscillator means.

7. A lock mechanism according to claim 5, in which:
the oscillator means comprises a transistor having a tuned-base circuit and a tuned collection circuit; and
the key means inserts a resonating component into the tuned-collector circuit.

8. A lock mechanism according to claim 5 in which:
the oscillator means output is rectified and connected through an amplifier to a relay having contacts operable upon energization to connect the energizing circuit of said bolt means with the voltage source.

9. A lock mechanism according to claim 5, in which:
the output of said oscillator means is connected to the input of a Schmitt trigger circuit having its output connected through an amplifier to a relay having contacts operable upon energization to connect the energizing circuit of said bolt means with the voltage source.